United States Patent [19]

Schmidlin et al.

[11] Patent Number: 4,752,810

[45] Date of Patent: Jun. 21, 1988

[54] CLEANING APPARATUS FOR CHARGE RETENTIVE SURFACES

[75] Inventors: Fred W. Schmidlin, Pittsford; Nero R. Lindblad, Ontario, both of N.Y.

[73] Assignee: Xerox Corporation, Stamford, Conn.

[21] Appl. No.: 695,495

[22] Filed: Jan. 28, 1985

[51] Int. Cl.[4] ..... G03G 21/00

[52] U.S. Cl. ..... 355/15; 15/256.52

[58] Field of Search ..... 355/3 R, 15; 15/256.51, 15/256.52

[56] References Cited

U.S. PATENT DOCUMENTS

| | | | |
|---|---|---|---|
| 3,572,923 | 3/1971 | Fisher et al. | 355/15 |
| 3,722,018 | 3/1973 | Fisher | 15/1.5 |
| 3,778,678 | 12/1973 | Masuda | 317/3 |
| 3,801,869 | 4/1974 | Masuda | 317/3 |
| 3,850,521 | 11/1974 | Saupe | 355/15 |
| 3,872,361 | 3/1975 | Masuda | 317/262 E |
| 4,101,215 | 7/1978 | Fottner et al. | 355/15 |
| 4,116,555 | 9/1978 | Young et al. | 355/15 |
| 4,172,303 | 10/1979 | Wooding et al. | 355/15 X |
| 4,265,990 | 5/1981 | Stolka et al. | 430/59 |
| 4,412,736 | 11/1983 | Sakamoto et al. | 355/15 |
| 4,423,950 | 1/1984 | Sagami | 355/15 |
| 4,505,577 | 3/1985 | Koizumi | 355/15 |

FOREIGN PATENT DOCUMENTS 56-66140 5/1981 Japan .

*Primary Examiner*—Fred L. Braun

[57] ABSTRACT

Cleaning apparatus for charge retentive surfaces. Travelling waves are generated by an electrode array and power source therefor which waves both remove toner particles from a cleaning brush and transport them to a remote location where they are collected for disposal. The cleaning brush which removes the toner particles from the charge retentive surface has a bias voltage applied thereto to enhance such toner removal.

4 Claims, 4 Drawing Sheets

CLEANING APPARATUS FOR CHARGE RETENTIVE SURFACES

This invention relates to printing apparatus and more particularly to cleaning apparatus for removing residual particles such as toner from a charge retentive surface forming a part of the printing apparatus.

In printing arts of the type contemplated, one method of forming images uses a charge retentive surface such as a photoreceptor or photoconductor. It comprises a photoconductive insulating material adhered to a conductive backing which is charged uniformly. Then the photoreceptor is exposed to a light image of an original document to be reproduced. The latent electrostatic images, thus formed, are rendered visible by applying any one of numerous pigmented resins specifically designed for this purpose. In the case of toner which forms the visible images is transferred to plain paper. After transfer, the toner images are made to adhere to the copy medium usually through the application of heat and pressure by means of a roll fuser.

Although a preponderance of the toner forming the images is transferred to the paper during transfer, some toner remains on the photoreceptor surface, it being held thereto by relatively high electrostatic and/or mechanical forces. It is essential for optimum operation that the toner and debris remaining on the surface be cleaned thoroughly therefrom.

A commercially successful mode of cleaning employed in automatic xerography utilizes a brush with soft bristles which have suitable triboelectric characteristics. While the bristles are soft they are sufficiently firm to remove residual toner particles from the xerographic plate. In addition, webs or belts of soft fibrous or tacky materials and other cleaning systems are known.

More recent developments in the area of removing residual toner and debris from a charge retentive surface have resulted in cleaning structures which, in addition to relying on the physical contacting of the surface to be acted upon also rely on electrostatic fields established by electrically biasing one or more members of the cleaner system.

It has been found that establishing an electrostatic field between the charge retentive surface and the cleaning member such as a fiber brush or a magnetic brush enhances toner attraction to the cleaning brush surface. Such arrangements are disclosed in U.S. Pats. Nos. 3,572,923 and 3,722,018 granted to Fisher et al on Mar. 22, 1973 and Fisher on Mar. 30, 1971, respectively. Likewise, when an electrostatic field is established between the brush and a brush detoning member, removal of toner from the brush is improved. The creation of the electrostatic field between the brush and photoreceptor is accomplished by applying a d.c. voltage to the brush. When the fibers or granules forming the brush are electrically conductive and a bias is applied thereto cleaning is observed to be more efficient than if the fibers or granules are non-conductive or insulative.

U.S. patent application Ser. No. 130,805 filed Mar. 17, 1980 now abandoned in the name of Seanor et al and assigned to the same assignee as this invention discloses a magnetic brush and insulative detoning roll both of which have electrical biases applied thereto for establishing the desired electrostatic fields between the brush and the photoreceptor and between the brush and detoning roll. This application was published in Brazil on Sept. 22, 1981.

The field established between the conductive brush and the insulative photoreceptor is such that the toner on the photoreceptor is positively charged then the aforementioned field would be negative or less positive. In order to attract the toner from the brush onto the detoning roll, the detoning roll is electrically biased to the same polarity but a greater negative or less positive potential than the brush.

A device that is structurally similar to the Seanor device is disclosed in U.S. Pat. No. 4,116,555. However, that device has a biased brush for removing background toner from a photoreceptor and has two rolls for removing the background particles from the background removal brush and returning same to the developer sump. To that end, the U.S. Pat. No. 4,116,555 device utilizes two detoning rolls which are biased to opposite polarities. In that way, both positive and negative toner in the background areas can be removed from the photoreceptor.

An improvement of the U.S. Pat. No. 4,116,555 device is disclosed in U.S. patent application Ser. No. 517,151 filed July 25, 1983, now U.S. Pat. No. 4,494,863 which is assigned to the same assignee as the instant application. In the device disclosed in the application Ser. No. 517,151 there are, as in the case of the U.S. Pat. No. 4,116,555, provided two detoning rolls co-acting with an electrically biased brush for removal of residual toner from a charge-retentive surface such as a photoreceptor. However, the Ser. No. 517,151 device unlike the U.S. Pat. No. 4,116,555 device is utilized to, not only remove residual toner and debris from the surface, but to separate the debris from the toner so that the toner can be reused.

One of the very latest methods for transporting particulate material employs travelling waves. U.S. Pat. No. 3,872,361 issued to Masuda discloses an apparatus in which the flow of particulate material along a defined path is controlled electrodynamically by means of elongated electrodes curved concentrically to a path, as axially spaced rings or interwound spirals. Each electrode is axially spaced from its neighbors by a distance about equal to its diameter and is connected with one terminal of a multi-phase alternating high voltage source. Adjacent electrodes along the path are connected with different terminals in a regular sequence, producing a wave-like, non-uniform electric field that repels electrically charged particles axially in wardly and tends to propel them along the path.

U.S. Pat. No. 3,778,678 also issued to Masuda relates to a similar device as that disclosed in the aforementioned U.S. Pat. No. 3,872,361.

U.S. Pat. No. 3,801,869 issued to Masuda discloses a booth in which electrically charged particulate material is sprayed onto a workpiece having an opposite charge, so that the particles are electrostatically attracted to the workplace. All of the walls that confront the workpiece are made of electrically insulating material. A grid-like arrangement of parallel, spaced apart electrodes, insulated from each other extends across the entire area of every wall, parallel to a surface of the wall and in intimate juxtaposition thereto. Each electrode is connected with one terminal of an alternating haihg voltage source, every electrode with a different terminal than each of the electrodes laterally adjacent to it, to produce a constantly varying field that electrodynamically repels particles from the wall. While the primary purpose of the device disclosed is for powder painting, it is contended therein that it can be used for electrostatic printing.

The Masuda devices all utilize a relatively high voltage source (i.e. 5–10 KV) operated at a relatively low frequency, i.e. 50 Hz, for generating his travelling waves. In a confined area such as a tube or between parallel plates, the use of high voltages is tolerable and in the case of the U.S. Pat. No. 3,801,869 even necessary since a high voltage is required to charge the initially uncharged particles.

The movement of toner for use in xerographic development system is disclosed in (Fuji Xerox's Japanese patent application No. 5666140) filed in Japan on May 7, 1981, a copy of which is enclosed. In that application, there is disclosed a device comprising an elongated conduit which utilizes travelling waves for transporting toner from a supply bottle to a toner hopper.

The movement of toner by means of travelling in a xerographic cleaning device is disclosed in U.S. Pat. No. 4,423,950, issued in the name of Shizuo Sagami. As disclosed therein, a brush is used to remove toner from a charge retentive surface. The brush is disposed within a housing but out of contact from it. The housing has an electrode arrangement capable of creating travelling waves designed to move toner about the inner surface of the housing so that it does not agglomerate thereon.

The movement of toner in a xerogrpahic cleaner device is also disclosed in U.S. patent application Ser. No. 563,729 filed Dec. 21, 1983, filed in the name of Ying-Wei Lin assigned to the same assignee as the instant application.

Applicants' invention in contrast to the devices described above uses a stationary toner conveyor having a linear electrode array disposed adjacent the outer surface thereof. The electrodes forming the array are in one embodiment of our invention co-extensive with the longitudinal axis of the conveyor and are connected to a relatively low voltage (i.e. 30–1000 volts) source operated at a relatively higher frequency, for example, 1 Kc. The toner is removed from a biased cleaning brush and transported from the brush about the circumference thereof, movement being caused by the travelling electrostatic waves generated by the electrode array. The toner particles are continuously scattered off the surface of the grid so that they bounce along making a miniature cloud of toner which extends above the surface approximately one wavelength. In the direction of motion, the clouds are about $\frac{1}{8}$ to $\frac{1}{4}$ of a wavelength long, so the clouds are actually tall and skinny. Only the particles closer to the surface actually collide with the surface.

As will be appreciated more fully from a detailed description of the invention, a stationary travelling wave electrode structure is utilized for both detoning a biased cleaning and trasporting toner to a collection area.

Other aspects of the present invention will become apparent as the following description proceeds with reference to the drawings wherein.

Inasmuch as the art of electrophotographic printing is well known, the various processing stations employed in the printing machine illustrated in FIG. 1 will be described only briefly.

Figure 1:
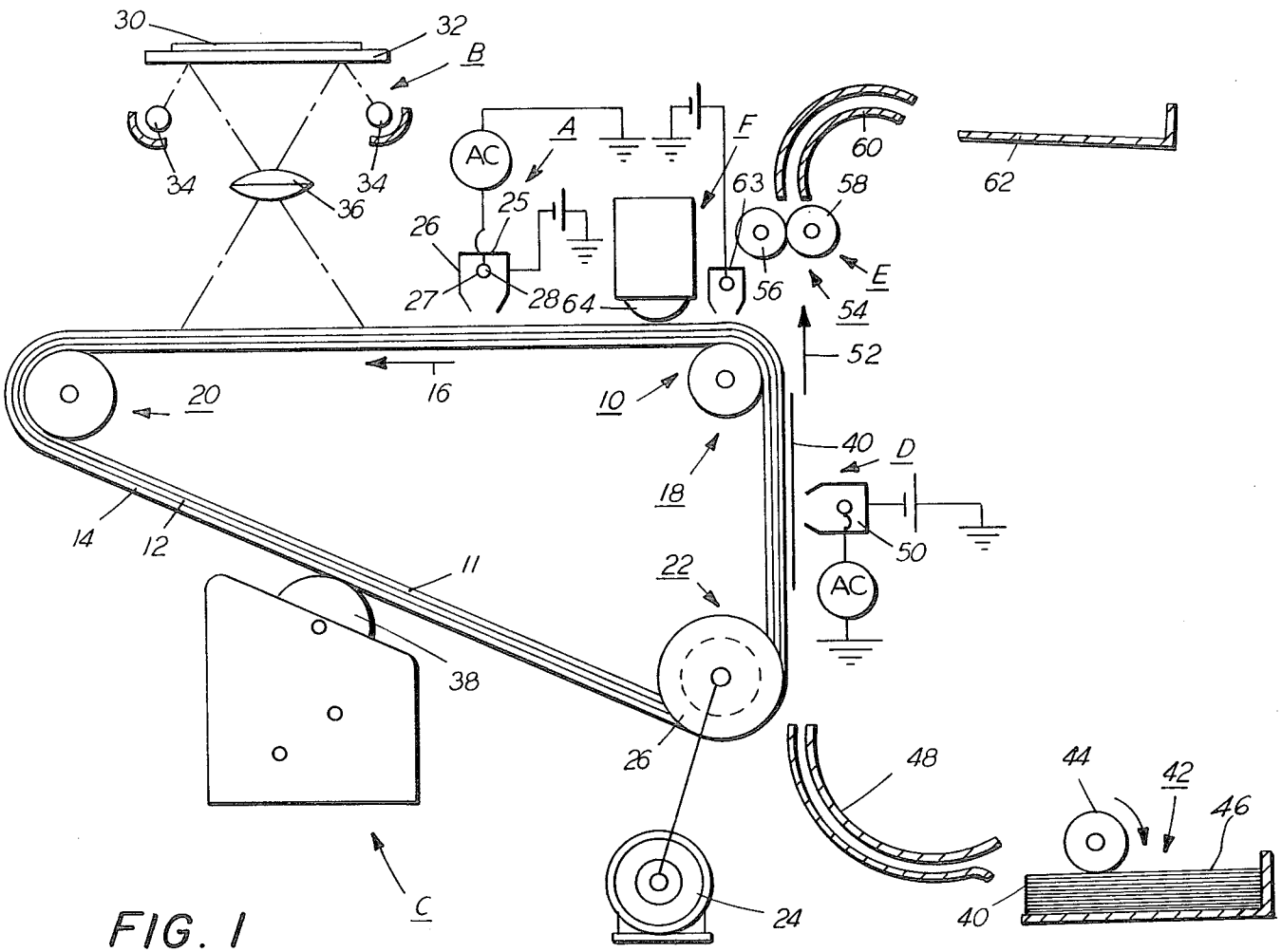
FIG. 1 is a schematic elevational view depicting an electrophotographic printing machine incorporating the present invention.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoconductive belt of the foregoing type belt is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof.

Belt 10 is entrained about stripping roller 18, tension roller 20 and drive roller 22. Roller 22 is coupled to motor 24 by suitable means such as a drive chain.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device, indicated generally by the reference numeral 25, charge layer 14 of belt 10 to a relatively high, substantially uniform negative potential. A suitable corona generating device for negatively charging the photoreceptor belt 10 comprises a conductive shield 26 and corona wire 27 the latter of which is coated with an electrically insulating layer 28 having a thickness which precludes a net d.c. corona current when an a.c. voltage is applied to the corona wire. Application of a suitable d.c. bias on the conductive shield 26 will result in suitable charge being applied to the photoreceptor belt as it is advanced through exposure station B. At exposure station B, an original document 30 is positioned face down upon a transparent platen 32. The light rays reflected from original document 30 form images which are transmitted through lens 36. The light images are projected onto the charged portion of the photoreceptor belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoreceptor belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator.

A preclean dicorotron 63 is provided for exposing the residual toner and contaminants to positive charges thereon so that a suitably biased cleaning roller, to be discussed hereinafter, will be more effective in removing them.

At a cleaning station F, residual particles such as toner and contaminants or debris such as paper fibers are removed from the photoreceptor surface by means of a brush (i.e. magnetic or fiber) 64 which is suitably biased by means of a power source 65 and which is rotated in the direction of the arrow 66 via motor 67. While the power source 65 is depicted as being negative for attracting positively charged toner from the photoreceptor 10, it may comprise a positive potential for attracting negatively charged toner. A stationary electrode grid structure 68 (FIG. 2) serves to both detone the brush 64 and transport the toner removed therefrom to a collection receptacle 70 adjacent one end of the grid structure 68. A suitable magnetic d.c. bias is applied to the grid 68 by means of a power source 69 in order to cause the toner particles to transfer from the brush 64 to the grid 68. The grid structure 68 is preferably constructed in the manner described in U.S. patent application Ser. No. 614,499 filed May 29, 1984, now U.S. Pat. No. 4,647,179, assigned to the same assignee as the instant application. The grid structure comprises a grid array comprising electrodes 71, the longitudinal axes of which extend from left to right (as viewed in FIG. 2 and are disposed in a side-by-side orientation. With the voltage source described in the aforementioned application applied to the electrodes, a travelling wave pattern is developed which causes toner to travel perpendicular to the electrodes 71. In the embodiment of the invention depicted in FIGS. 2 and 3 the brush has a generally cylindrical shape while the grid structure has a generally planar shape.

Figure 2:
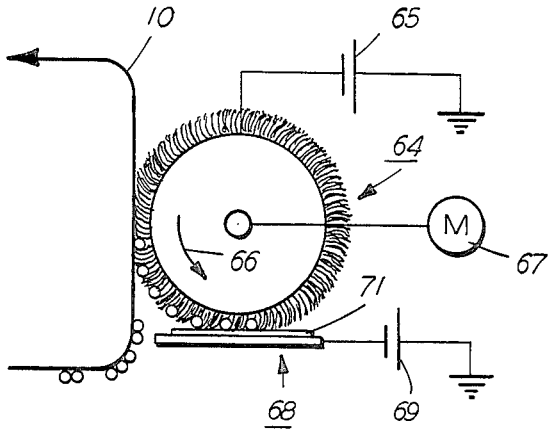
FIG. 2 is a schematic side elevational view of one embodiment of a toner removal and transport device incorporated in the invention.
Figure 3:
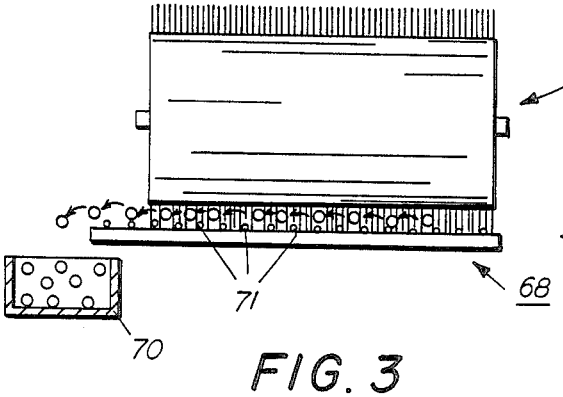
FIG. 3 is a schematic front elevational view of the device illustrated in FIG. 2.
Figure 4:
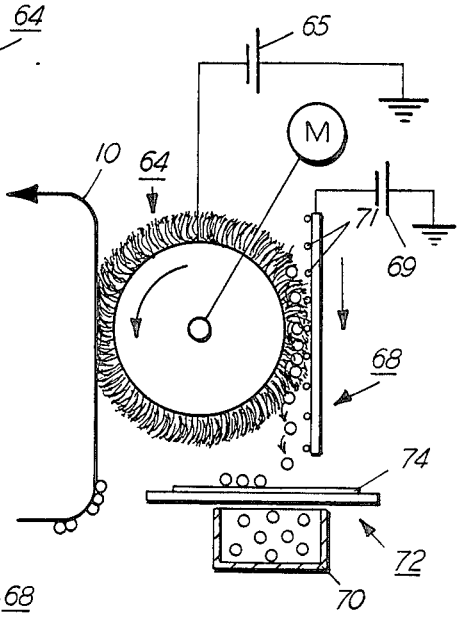
FIG. 4 is a schematic side elevational view of another toner removal and transport device.
Figure 5:
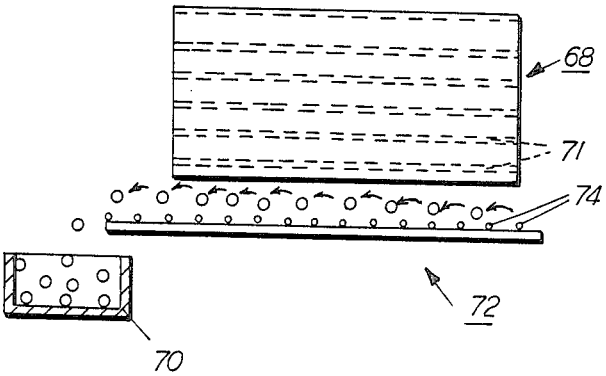
FIG. 5 is a schematic front elevational view of the device of FIG. 4.

The embodiment of the invention disclosed in FIGS. 4 and 5 comprise a biased brush 64 and a grid structure 68 which are identical to the corresponding members of the embodiment of FIGS. 2 and 3. A second electrode structure 72 comprises electrodes 74 which extend in the direction of the longitudinal axis of the brush as viewed in FIG. 5.

Figure 6:
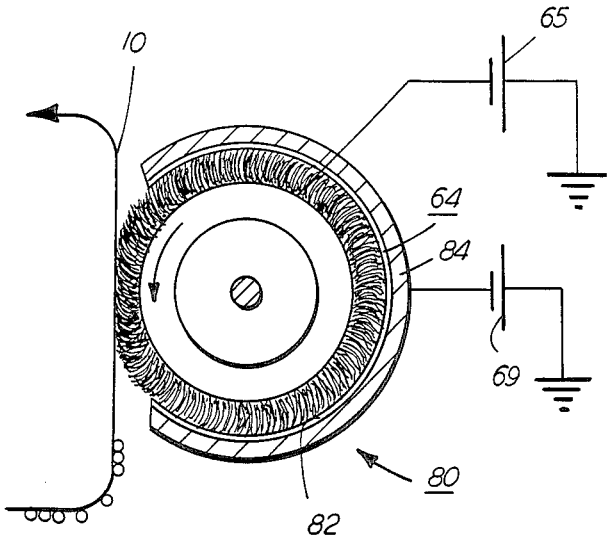
FIG. 6 is a schematic side elevational view of still another toner removal and transport device.
Figure 7:
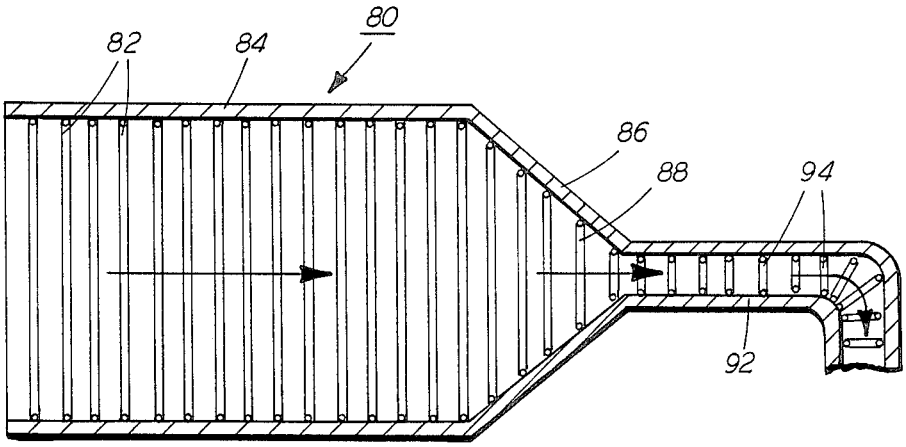
FIG. 7 is a cross-sectional view of a toner transport device incorporated in the device of FIG. 6.

Another embodiment as illustrated in FIGS. 6 and 7 comprises a cleaning brush 64 partially surrounded by a grid structure 80 having electrodes 82 (FIG. 7) which are positioned about the inner circumference of an acute-shaped base portion 84 on which the electrodes are mounted. The electrodes are disposed such that they are perpendicualr to the longitudinal axis of the brush. The grid structure also comprises a funnel-shaped portion 86 having continuous electrodes 88 mounted about the inner curcumference thereof. Toner is moved from the funnel-shaped portions 86 to a cylindrical transport tube 92 having electrodes 94 disposed about the inner surface thereof.

Figure 8:
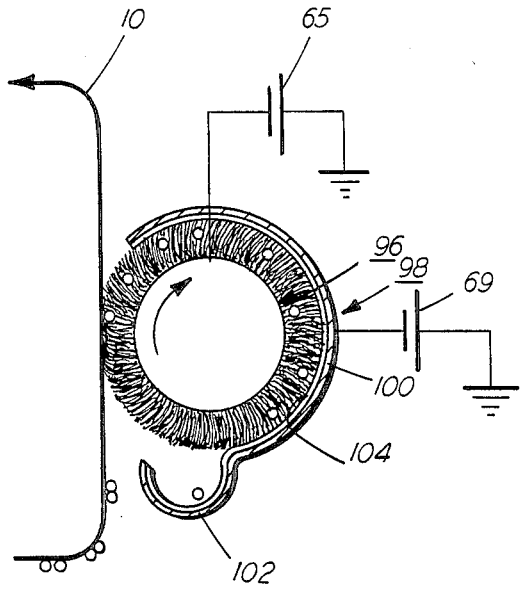
FIG. 8 is a schematic side elevational view of yet another toner removal and transport device.
Figure 9:
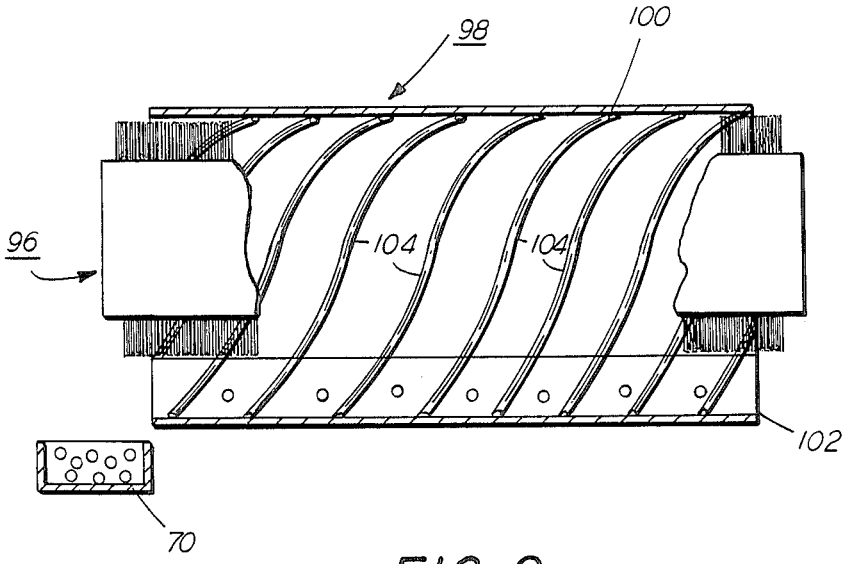
FIG. 9 is a schematic front elevational view of the device in FIG. 8.

Depicted in FIGS. 8 and 9 is yet another embodiment of the invention which comprises a brush structure 96 and a grid structure 98. The grid structure 98 has a generally cylindrically-shaped portion 100 formed integrally with a trough 102. Electrodes 104 provided in the surface of the portion 100 are spirally oriented as shown in FIG. 9 in order to establish a travelling wave pattern which moves the toner removed from the brush generally along the longitudinal axis and angularly of the brush such that it ultimately moves into the trough 102. After the toner reaches the trough it is moved longitudinally toward one end of the trough. As will be appreciated in this embodiment the portion 100 and the trough share the same electrodes whereas in the other embodiments their counterparts have separate electrodes.

In view of the foregoing description it should now be apparent that the cleaning apparatus disclosed utilizes travelling waves to both remove toner from a cleaning brush and carry the toner away to a remote point. It does so effectively with the use of a minimum number of moving parts thereby providing a device which is less complicated in construction.

We claim:

1. Apparatus for cleaning toner particles from a charge retentive surface, said apparatus comprising:

an endless toner particle removal member supported for movement in a first direction such that portions thereof move into and out of contact with said charge retentive surface; and at least one travelling wave electrode structure stationarily supported in contact with said particle removal member, said electrode structure being capable of generating travelling waves adapted to move toner particles away from said particle removal member in a direction transverse to said first direction; and a second travelling wave electrode structure supported out of contact from said particle removal member, said second electrode structure being capable of generating travelling waves for moving toner particles in a direction substantially perpendicular to the direction of movement caused by said at least one travelling wave electrode structure.

2. Apparatus according to claim 1 wherein said at least one electrode structure comprises individual electrodes which are oriented in a direction that is substantially perpendicular to the longitudinal axis of said particle removal member.

3. Apparatus including a charge retentive surface for forming toner images on copy substrates, said apparatus including means for cleaning toner particles from the charge retentive surface, said apparatus comprising:

an endless toner particle removal member supported for movement in a first direction such that portions thereof move into and out of contact with said charge retentive surface; and at least one travelling wave electrode structure stationarily supported in contact with said particle removal member, said electrode structure being capable of generating travelling waves adapted to move toner particles away from said particle removal member in a direction transverse to said direction; and a second travelling wave electrode structure supported out of contact from said particle removal member, said second electrode structure being capable of generating travelling waves for moving toner particles in a direction substantially perpendicular to the direction of movement caused by said at least one travelling wave electrode structure.

4. Apparatus according to claim 3 wherein said at least one electrode structure comprises individual electrodes which are oriented in a direction that is substantially perpendicular to the longitudinal axis of said particle removal member.

* * * * *